United States Patent [19]

Devir

[11] Patent Number: 4,877,992

[45] Date of Patent: Oct. 31, 1989

[54] ELECTRIC LAMP HAVING CONDUCTORS WITH MEANS FORMED THEREIN FOR REMOVING CONTACT SURFACE MATERIAL

[75] Inventor: Daniel D. Devir, S. Sutton, N.H.

[73] Assignee: GTE Products Corporation, Danvers, Mass.

[21] Appl. No.: 71,235

[22] Filed: Jul. 9, 1987

[51] Int. Cl.[4] ..... H01J 5/48

[52] U.S. Cl. ..... 313/318; 313/315; 313/316; 439/611; 439/612

[58] Field of Search ..... 313/318, 316, 315, 331, 313/332; 339/144 R, 144 T, 145 R, 145 D; 439/610–615

[56] References Cited

U.S. PATENT DOCUMENTS

| | | | |
|---|---|---|---|
| 3,594,602 | 7/1971 | Lindburg | 313/316 |
| 4,028,577 | 6/1977 | Gates et al. | 313/318 |
| 4,054,346 | 10/1977 | Schultz | 313/318 |
| 4,603,278 | 7/1986 | Devir et al. | 313/318 |

*Primary Examiner*—Leo H. Boudreau
*Assistant Examiner*—Michael Razavi
*Attorney, Agent, or Firm*—Lawrence R. Fraley

[57] ABSTRACT

An electric lamp including an insulative (e.g., plastic) base, an envelope located within the base and having a filament therein and a pair of conductors (e.g., nickel-iron alloy wires) projecting externally from the envelope, passing through the base and extending therefrom. Each conductor includes means (e.g., knurls) formed therein for removing undesirable surface material (e.g., oxide) from a respective contact located within a socket in which the lamp is positioned. Such removal, achieved during lamp insertion and eventual withdrawal, thus assures a sound electrical connection between the "cleaned" contact and a second lamp designed to replace the original. These features are particularly advantageous in the automotive field, especially that portion of the field involving taillight and similar assemblies.

9 Claims, 2 Drawing Sheets

ELECTRIC LAMP HAVING CONDUCTORS WITH MEANS FORMED THEREIN FOR REMOVING CONTACT SURFACE MATERIAL

DESCRIPTION

1. Technical Field

The invention relates to electric incandescent lamps and, more particularly, to such lamps which include an electrically insulating base as part thereof. Even more particularly, the invention relates to such lamps which are adapted for being positioned within a socket having contacts (e.g., spring-loaded) therein.

2. Background

The features of the present invention are particularly useful as applied to the construction of incandescent lamps employed in automobiles, such as the dual-filament lamps employed in taillight assemblies.

One well known example of existing lamps of this type generally employed a type S-8 glass bulb cemented in a brass, double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production thereof. Further, the lamp to base construction for dual filament lamps of this type requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

One attempted solution to the several aforementioned problems inherent in brass base lamps is defined in U.S. Pat. No. 4,028,577 (P. E. Gates et al), said patent assigned to the same assignee as the instant invention and being a continuation-in-part of U.S. Pat. No. 3,979,627 (S. J. Leadvaro et al). In U.S. Pat. No. 4,028,577, there is described an electric lamp having a sealed end containing therein (or extending therefrom) a reentrant glass stem sealed about its periphery to the glass bulb. This end is positioned within a plastic base having a cylindrical body portion (for housing the somewhat cylindrical-shaped sealed end) and adjacent wedge portion. While this concept proved advantageous in several ways over the aforementioned brass base lamps, it was necessary to provide additional features, steps, etc. in order to satisfactorily produce and utilize this arrangement. For example, it was necessary to position the extending tip segment (from the sealed end) a sufficient distance from the base's inner, bottom wall in order to provide protection thereof. Maintenance of this distance was assured by cementing the bulb (along the outer walls) to the base. It was also necessary in this design to pass the lamp's projecting lead-in wires through corresponding passages (holes) within the base, thus mandating a relatively complex (and time-consuming) alignment and insertion procedure. Even further, final lead-in wire retention necessitated yet another production step (e.g., heat staking) which added still further to the cost of this lamp.

In U.S. Pat. No. 4,603,278 (D. D. Devir et al), there is defined an electric lamp which includes an insulating base through which the lamp envelope's conductors pass and extend therefrom. These conductors are aligned on the base to lie in a retained fashion on the base's outer surface such that contact between these conductors and the corresponding socket contacts (the lamp being inserted within the socket) is facilitated. U.S. Pat. No. 4,603,278 is assigned to the same assignee as the instant invention.

As will be understood from following, the teachings of the invention apply to electric lamps having insulative (e.g., plastic) bases as part thereof. Though not specifically limited to such, the invention's teachings are particularly applicable to a lamp such as defined in U.S. Pat. No. 4,603,278. It is of course also adaptable to lamps of other configurations and characteristics (e.g., voltages, wattages, etc.).

DISCLOSURE OF THE INVENTION

It is therefore a primary object of this invention to enhance the electric lamp art.

It is a particular object of this invention to provide an electric lamp which is relatively simple in design, and which can be readily and inexpensively produced.

It is yet another object of this invention to provide such a lamp wherein the lamp's projecting lead-in wire conductors, in addition to being positively aligned and retained externally of the lamp's base, include means formed therein for enhancing the electrical connection formed between these conductors and the contacts which form part of the socket assembly when the lamp is positioned within the socket.

These and other objects, advantages and features are attained, in accordance with the principles of this invention, by an electric lamp comprising a sealed envelope having a sealed end portion, at least one filament located within the interior of the envelope, a pair of lead-in conductors each electrically coupled to the filament and exteriorly projecting therefrom, and an electrically insulating base member having the envelope positioned therein such that the envelope's conductors pass through the base and extend therefrom in predetermined alignment. Each conductor includes means formed therein for removing undesirable surface material (e.g., oxide) from the respective contact during insertion and removal of the lamp within the socket. Such removal improves subsequent contact (e.g., by a second lamp inserted in the socket).

BEST MODE FOR CARRYING OUT THE INVENTION

Figure 1:
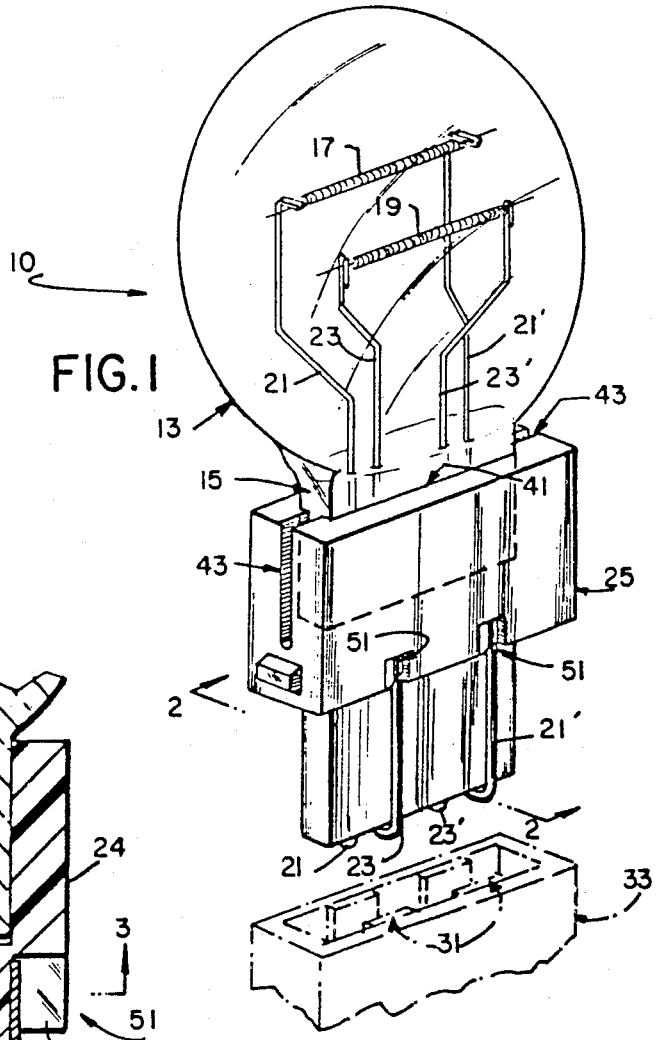
FIG. 1 is a perspective view of an electric incandescent lamp utilizing the teachings of the instant invention.

For a better understanding of the present invention together with other and further objects, advantages and capabilities thereof, reference is made to the following disclosure and appended claims in connection with the above-described drawings.

With particular attention to the drawings, there is illustrated an electric incandescent lamp 10 in accordance with a preferred embodiment of the invention. Lamp 10, as stated above is particularly adapted for use as part of a taillight assembly in an automobile but it will also be understood from the teachings herein that the invention has many further uses (e.g., automobile and aircraft instrument lighting, telephone switchboard lighting, etc.) and these teachings are thus not limited to this particular environment. Lamp 10, as defined herein, contains many of the features of the lamp in U.S. Pat. No. 4,603,278 and includes a light-transmitting envelope in the form of a glass (e.g., lime glass) bulb 13, said bulb containing therein a rare gas such as argon established at approximately atmospheric pressure. Bulb 13 is preferably press (pinch) sealed at one end thereof using a pressing operation known in the incandescent lamp industry. Accordingly, further description is not believed necessary. As a result of this pressing operation, a flattened, sealed end portion 15 is formed as part of bulb 13 adjacent the bulbous part of the envelope. End portion 15 is preferably of substantially rectangular configuration when viewed in cross section therethrough, in comparison to the bulbous shape of bulb 13, which may be either substantially cylindrical (tubular) or spherical (round) in shape. Additionally, end portion 15 as formed by the aforementioned pressing technique, possesses greater strength (resistance to breakage) over ends sealed using a tipping operation or the like, or sealed in the manner defined in the aforementioned U.S. Pat. Nos. 3,979,627 and 4,028,577. In addition, the substantially rectangular (in cross section) shape resulting from this technique is particularly suited for placement thereon of an insulative base possessing the several features described hereinbelow.

Located within bulb 13 is a pair of filaments 17 and 19, each of which is electrically connected to (and secured by) a corresponding pair of lead-in conductors which are hermetically sealed within end portion 15 of bulb 13 and project exteriorly thereof. The opposing ends of each pair extend within the interior of bulb 13 and may be bent as indicated to assure the desired positioning for both filaments. With particular attention to the drawings, filament 17 is connected (and energized) by lead-in conductors 21 and 21', while filament 19 is connected by conductors 23 and 23'. A total of four conductors thus project exteriorly from sealed end portion 15.

It is also understood that bulb 13 may contain but a singular coiled filament and that only one pair of conductors would be utilized in such event. It is further understood that by the term "lead-in conductor" is meant also to include any conductor which is coupled, electrically, to the contained filament. Such a conductor may be formed of more than one wire member, with these being connected (e.g., welded) to form a singular component. Additionally, such a composite may include individual members of different cross-sectional shape (e.g., cylindrical, rectangular) and/or conductive (e.g., metal) materials.

In accordance with a preferred embodiment of the invention, filaments 17 and 19 are each of coiled configuration and comprised of tungsten. By the term coiled configuration is meant that each filament may constitute a singular coil or, alternatively, may be a coiled-coil member. Retention of each filament by the associated pair of lead-in conductors is attained by crimping the interior ends thereof over the opposed ends of the linear filament, said procedure known in the art of incandescent lamp making. Each lead-in conductor is preferably comprised of a metallic alloy material (e.g., nickel-iron alloy) or similar conductive material known in the art. In one embodiment, each conductor possessed an outer (external) diameter (O.D.) of about 0.020 inch and a total length of about 2.700 inches, of which about 1.400 inch projects externally from end portion 15. It is thus understood that a substantial (more than half) portion of each conductor projects exteriorly of sealed end 15.

In accordance with the teachings herein, lamp 10 further includes an electrically insulating (e.g., plastic) base member 25 which, as shown, is secured to the press sealed end portion 15 of the lamp's envelope adjacent the bulbous portion 13 and designed for providing a cover therefor. Base member 25 is of unitary construction and preferably includes a relatively larger first portion 24 and a smaller (in thickness) protruding second portion 24' adjacent first portion 24. Located within second portion 24' may be located a plurality of apertures 26 (one shown in FIG. 2) each of which extend through the protruding portion 24' and are designed for having a respective exteriorly projecting portion of a lead-in conductor pass therethrough. Although individual apertures 26 are provided for each conductor, it is also possible to utilize a single slot (or channel) for this purpose, wherein all conductors are located therein in a side-by-side, non-contacting (to assure electrical insulation) relationship. First portion 24 of base member 25 also preferably includes therein means for maintaining exteriorly extending portions of the four lead-in conductors in predetermined alignment against an external surface of a respective one of the sidewalls of the first portion of the insulating base member to thereby assure that these extending exposed portions will be precisely aligned with corresponding electrical contacts (i.e., 31, shown in phantom in FIG. 1) utilized in a socket 33 (also shown in phantom in FIG. 1) into which lamp 10 is designed for being positioned. As understood herein, this positioning is accomplished by inserting the protruding second portion 24' of the base member 25 directly within socket 33 such as illustrated in FIG. 1 such that connection is made to the retained and aligned exposed portions of the respective lead-in conductors 21, 21', 23 and 23' in the region of this protruding portion (and thereby against this portion). It is thus possible to provide a socket member of relatively simple construction capable of receiving lamp 10.

Figure 2:
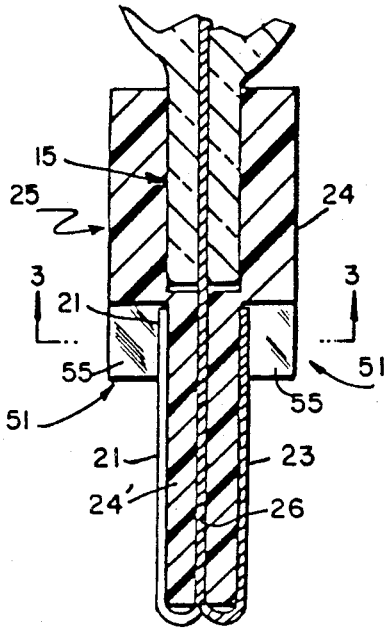
FIG. 2 is an enlarged, side elevational view of the lamp of FIG. 1 as taken along the line 2—2 in FIG. 1.

Base member 25, as stated, is preferably of unitary construction and defines therein an elongated opening 41 also of substantially rectangular configuration and designed for having the flattened press sealed end portion 15 securedly positioned therein. Opening 41 extends into the first portion 24 of base member 25 an established depth, as indicated in FIG. 2. To assure positive positioning therein without causing damage to the sealed end portion 15, the first portion 24 of base member 25 preferably further includes flexure means 43 therein to enable this part of the base member to expand a predetermined amount during said positioning. Flexure means 43 is preferably in the form of two elongated slots formed within the narrower interconnecting sidewalls of the base member's first portion to thus enable the larger sidewalls to expand outwardly during positioning of the press sealed end portion 15. Preferably, two slots are utilized, although it is understood that only one of these may be provided.

To maintain the externally projecting portions of the four lead-in conductors (those portions which project from the protruding second portion 24' of base member 25) in the described predetermined alignment and thereby assure effective contact therewith at the location indicated, base member 25 further includes a plurality of spacedly positioned channels 51, each located within the lowermost portion of the first portion of the base member and designed for having one of the terminal ends of a respective conductor inserted therein. See also FIG. 4. As will be described below, each of these channels is designed for securedly retaining these terminal ends in a locking relationship to thus prevent subsequent removal thereof during the aforementioned positioning of the invention within corresponding socket member 33. A total of four channels are provided, one for each of the mentioned lead-in conductors. It is understood in the broader aspects of its invention, however, that only two such channel members may be provided in the event that only one filament is utilized (and thus only two lead-in conductors similarly employed). Because it is desired to position the conductors from each filament on opposite sides of the base member's first portion 24, it is understood that if only two channel members are employed, these would also be oriented within said opposite sides (or sidewalls) of the first portion.

Figure 3:
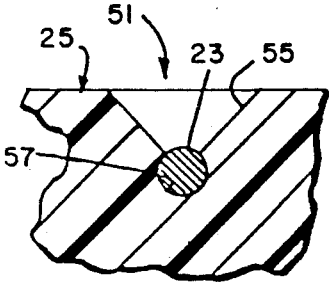
FIG. 3 is an enlarged, end elevational view, in section, of the lamp of FIG. 1 as taken along the line 3—3 in FIG. 2.
Figure 4:
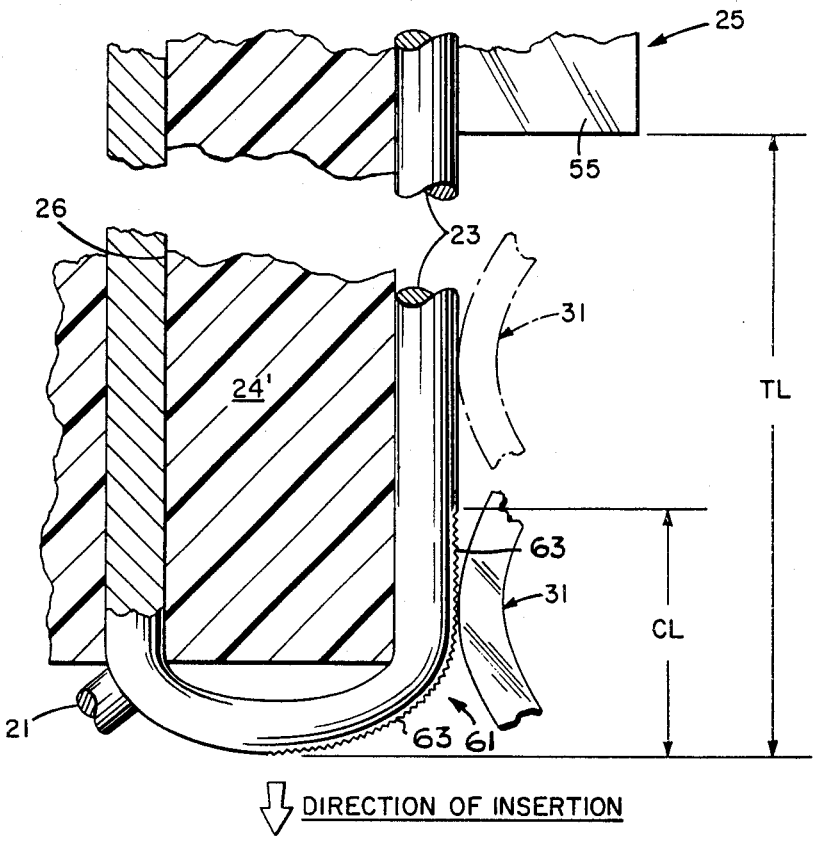
FIG. 4 is a much enlarged, partial side elevational view of the lamp of FIG. 1 illustrating the preferred contact surface material removal means of the invention, said means formed within the invention's extending conductors.

As better depicted in FIGS. 2, 3 and 4, each channel includes a tapered portion 55 which, as illustrated, facilitates positioning of the annular conductors therein. Accordingly, each channel further includes an annular opening 57 (FIG. 3) at the bottom thereof. With particular attention to FIG. 3, each of the illustrated tapered portions 55 defines a relatively narrow passage between these tapered walls and the corresponding annular opening 57. Said passage is of a narrower width than the corresponding external diameter for the respective lead-in conductor being positioned therein. In addition, the corresponding annular opening 57 designed to accommodate the conductor is of an outer diameter substantially similar (or perhaps very slightly larger) than the corresponding outer diameter of the conductor. Understandably, the metallic conductor, when pressed within annular opening 57, is thus retained therein (and thus against the narrower protruding portion 24') in the aforementioned locking relationship.

In accordance with the teachings of the invention, each of the conductors includes therein means 61 for removing undesirable surface material (not shown) from the respective contact 31 during insertion and removal of lamp 10 within socket 33. One example of such material is an oxide formed on the contact's outer surface as a result of prolonged exposure to an adverse environment (e.g., such as one to which automobile taillights are typically exposed). Such an oxide layer (barrier) will understandably impede contact between conductor and contact members such that an inadequate connection may occur when a second lamp is inserted within the socket. As understood herein, means 61 is capable of removing such undesirable material during initial insertion of the lamp whereby the portion of the conductor which ultimately engages the contact will engage a substantially clean surface. Moreover, means 61 is also capable of effecting removal of said removed material when lamp 10 is withdrawn from socket 33 (e.g., due to lamp failure and the need for replacement). This is best shown in FIG. 4 where the protruding portion 24 of base 25, having the exteriorly extending conductors 21 and 23, is indicated as moving in a direction (downward) of insertion. Initially, means 61, a roughened surface preferably comprised of a plurality of knurls 63 formed within the outer surface of the cylindrical conductor (only being shown in conductor 23 in FIG. 4), contacts the outer, flat surface of a respective contact (31 in FIG. 4) and, during the subsequent stages of lamp insertion, "wipes" across this surface substantially removing the described oxide layer. When lamp 10 is fully inserted, the non-knurled, smooth upper portion of conductor 23 engages contact 31, said final positioning also being illustrated in FIG. 4 (contact 31 being shown in phantom). Because contact 31 has been "cleaned", a sound electrical connection at this location is assured.

As seen in FIG. 4, only a portion (dimension "CL") of the total length (dimension "TL") of the conductor capable of effecting contact with a corresponding contact includes means 61 therein. Preferably, this is from about ten to thirty percent of the exposed total length, depending on the dimension and/or final configuration of the components which form the lamp-socket assembly. In a specific example, TL was about 0.450 inch and CL was about 0.094 inch.

Although a knurled surface is shown in FIG. 4, it is possible to form means 61 by alternative measures. One preferred alternative is to sandblast the portion of the conductor. In either event (knurling or sandblasting), a surface depth of approximately ten to twenty percent of the total diameter (e.g., 0.020 inch) of the conductor is reached. By way of example, knurls having a depth of about 0.003 inch were formed in 0.020 inch diameter nickel-iron alloy conductors.

Although only conductor 23 is shown as including means 61 therein, it is understood that both conductors are similarly formed. Such is also true for all of the other conductors (e.g., should four (or more) conductors be utilized).

Surprisingly, means 61 was capable of effectively removing oxide and other undesirable surface materials from the spring-loaded contacts 31 even though the hardness of the metallic nickel-iron alloy material for the conductors was less than that of the clad, beryllium-copper alloy contacts. Such removal was also effectively achieved considering the cylindrical (in cross-section) shape of each conductor and its contact with a flat, broader surface on the respective contact. In effect, only a relatively narrow, vertical surface area of contact was available using components having such dimensional constraints.

There has thus been shown and described an electric incandescent lamp wherein the externally projecting lead-in conductors thereof include means formed therein for removing undesirable surface material from the contacts in a socket in which the lamp is positioned. Such removal enhances contact between the contacts (at the smooth portions thereof) as well as subsequent contact between the contacts and conductor of a newly positioned lamp.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electric lamp for being removably positioned within a socket having electrical contacts therein, said lamp comprising:

an insulative base;

an envelope located within said base and having at least one filament therein;

a sealed end portion and a pair of conductors coupled to said filament and projecting exteriorly of said sealed end portion and passing through said base to extend therefrom in a predetermined alignment on said base, each of said conductors electrically connected to a respective one of said contacts within said socket when said lamp is positioned therein; and means for removing surface material from said contacts during insertion and removal of said lamp within said socket, said means comprising a roughened surface within at least a portion of each of said conductors which extends from said base, said means thereby improving electrical contact between said conductors and said contacts.

2. The electric lamp of claim 1 wherein said roughened surface is knurled.

3. The electric lamp of claim 1 wherein said roughened surface is sandblasted.

4. The electric lamp of claim 1 wherein each of said portions of said conductors having said roughened surface therein comprises from about 10 percent to about 30 percent of the total length of said conductors which extend from said base for contacting said contacts.

5. The electric lamp of claim 1 wherein said roughened surface occupies a depth of from about 10 percent to about 20 percent of the total thickness of each of said conductors.

6. The electric lamp of claim 1 wherein the hardness of each of said contacts is greater than the hardness of each of said conductors.

7. The electric lamp of claim 6 wherein the material removed by said means formed within each of said conductors is oxide.

8. The electric lamp of claim 6 wherein each of said contacts is comprised of a beryllium-copper alloy and each of said conductors is comprised of a nickel-iron alloy.

9. The electric lamp of claim 1 wherein each of said contacts has a contacting surface of substantially flat configuration and each of said conductors is of substantially cylindrical cross-sectional configuration.

* * * * *